US005134745A

United States Patent [19]

Burns et al.

[11] Patent Number: 5,134,745

[45] Date of Patent: Aug. 4, 1992

[54] PAINT TRIMMING DEVICES

[76] Inventors: Fredrick R. Burns, 8866 Greenmeadow La.; Bruce C. Polzin, 8879 Greenmeadow La., both of Greendale, Wis. 53129; Paul H. Mylander, 13191 W. Scarborough, New Berlin, Wis. 53151

[21] Appl. No.: 698,819

[22] Filed: May 13, 1991

[51] Int. Cl.[5] ..... A47L 13/00; A47L 13/06

[52] U.S. Cl. ..... 15/210.1 R; 15/248.1

[58] Field of Search ..... 15/210 R, 248 R, 209 R, 15/176.4, 166, 246, 416, 421, 364

[56] References Cited

U.S. PATENT DOCUMENTS

| | | | |
|---|---|---|---|
| 2,810,148 | 10/1957 | Wood, Jr. | 15/210 R |
| 2,907,061 | 10/1959 | Whalen | 15/166 |
| 3,172,140 | 3/1965 | Burns et al. | 15/246 |
| 3,359,589 | 12/1967 | Moore | 15/210 R |
| 3,708,821 | 1/1973 | Chase et al. | 15/210 R |
| 4,852,203 | 8/1989 | LaBelle | 15/210 R |

*Primary Examiner*—Timothy F. Simone
*Assistant Examiner*—Reginald L. Alexander

[57] ABSTRACT

An improved paint trimming device of the pad type, for precisely painting surfaces up to but not beyond a junction. The base of the device, to which the pad is secured, is provided with a hand grip and an edger in the form of a face plate which extends a substantial distance along the front edge of the base. The edger has runner means which projects downwardly from the lower edge of the face plate and which, when oriented generally perpendicularly to the paint pad, terminates short of the paint pad and projects downwardly only a distance sufficient to enable paint carried by the paint pad to be placed precisely up to a junction but not beyond.

8 Claims, 2 Drawing Sheets

PAINT TRIMMING DEVICES

This invention relates generally to paint applicators of the pad type, and more specifically to such an applicator by which the edges of a surface adjacent to another surface may be neatly painted, and corners formed by the junction of planar surfaces may be precisely painted.

BACKGROUND OF THE INVENTION

Paint pads intended to be used to paint edges of one surface near an adjacent surface usually employ a wheel or wheels offset but generally parallel to a paint pad surface. One such example is shown in U.S. Pat. No. 3,605,165. Another example is shown in U.S. Pat. No. 2,810,148. There are still others. From a marketing standpoint, these and similar tools are very successful and have long been staple items in paint stores and paint departments.

While all of these inventions are useful in painting a surface which abuts an adjacent surface, they require that the adjacent surface extend far enough away from the area being painted so that the wheel(s) will engage the adjacent surface and keep the paint pad bristles from contacting that adjacent surface.

The practical application of this principle prevents these trimming devices from being useful when the adjacent surface does not extend at least on the order of about ¼ inch outwardly beyond the surface being painted. This is because this distance is the practical minimum limitation for offsetting the wheel from the pad face. This limitation is commonly encountered when the adjacent surface is the top edge of most baseboard molding used at the base of an interior wall. These edges are generally in the range of ⅛ inch to 3/32 inch thickness. Since the wheel(s) do not engage the edge of the molding, the device will not paint a neat edge. Another approach is taught in U.S. Pat. No. 3,172,140. This approach, as shown in FIGS. 1, 2, and 3 in that patent, uses a continuous blade element 55 which is pivoted as shown in FIG. 2 so that the pad face can be loaded without getting paint on the blade, and then uses the blade as a mask to keep the pad face away from the abutting surface as shown in FIG. 3. Although it functions with a minimally extending adjacent surface, this approach has two limitations: (1) The masking effect of the blade prevents the paint carrying bristles in the pad face from actually reaching the exact corner (the closeness is controlled by the blade thickness) which leaves a thin unpainted line next to the adjacent surface; and (2) when the adjacent surface is textured, such as is commonly found on ceilings, the blade is not as easy to use as the wheel previously described, and the blade edge scrapes the adjacent surface and is abraded by this action.

Consider this practical example: A 10′×12′ room with a door and window will have: (A) 44 linear feet of ceiling edge to be trimmed, (B) 29 feet of door and window frame to be edge trimmed, and (C) 41 feet of baseboard edge to be trimmed. "A" can be painted efficiently with a wheel-type trimming device. "C" can be trimmed only with the blade-type device. "B" can be trimmed with either style.

SUMMARY OF THE INVENTION

The invention herein disclosed is equally well adapted to all of the painting environments mentioned above. In essence the paint pad device of this invention is exceedingly versatile. It can be operated with wheels if desired for painting in one environment, and, with merely a quick change of parts, adapted to operate in a setting in which a wheel-type device would not give completely satisfactory results.

The invention, by virtue of the contour of a forward blade element, is particularly well-adapted to paint into exact corners defined by intersecting planar surfaces without putting paint on any but the desired single surface.

The foregoing advantages are achieved in an inexpensive, easily assembled and manipulated paint pad trimming device which is hereinafter described in detail.

BRIEF DESCRIPTION OF THE DRAWING

The invention is illustrated more or less diagrammatically in the accompanying drawing wherein.

DETAILED DESCRIPTION OF THE INVENTION

Figure 1:
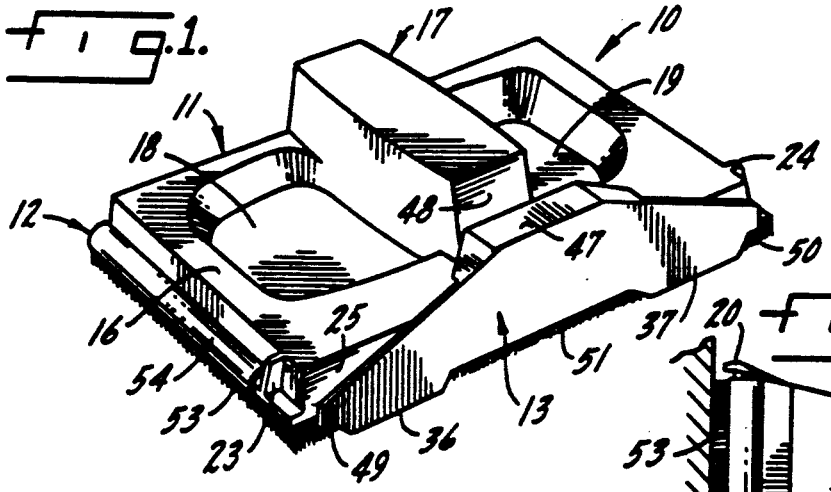
FIG. 1 is a perspective of the paint trimming device of this invention in an assembled condition preparatory to being used to do edge trim work.

Like reference numerals will be used to refer to like parts from Figure to Figure of the drawing.

The improved paint trimming device of this invention is indicated generally at 10 in FIG. 1.

Figure 7:
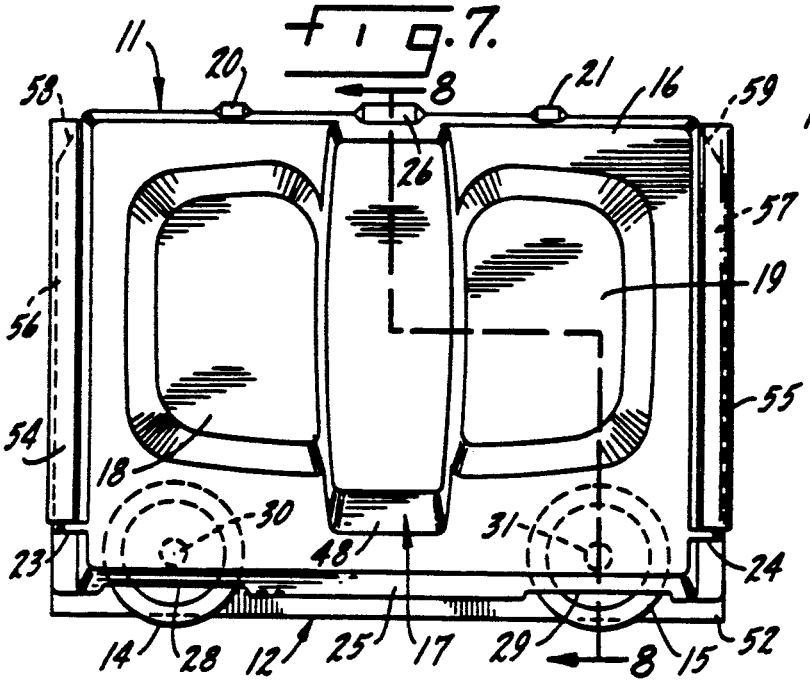
FIG. 7 is a top plan view of the trimming device as it appears in a two wheeled edger mode.
Figure 8:
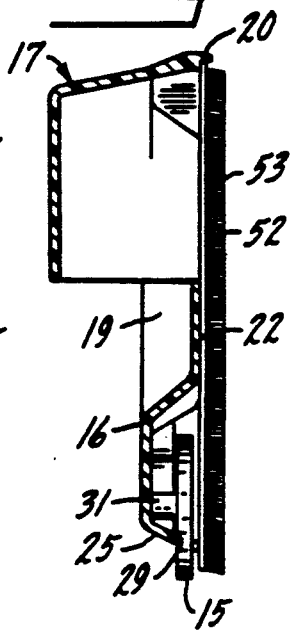
FIG. 8 is a view taken substantially along the line 8—8 of FIG. 7.
Figure 9:
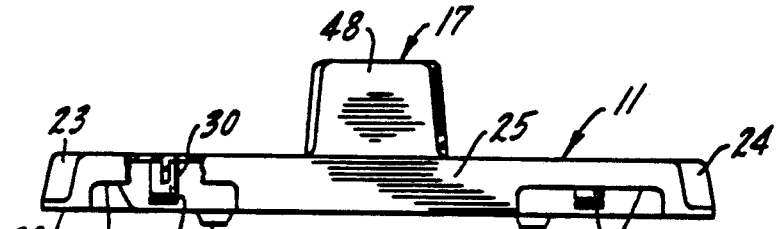
FIG. 9 is a front view of the body or base of the edger of FIG. 7 with the wheels and paint pad removed and parts broken away for clarity.
Figure 10:
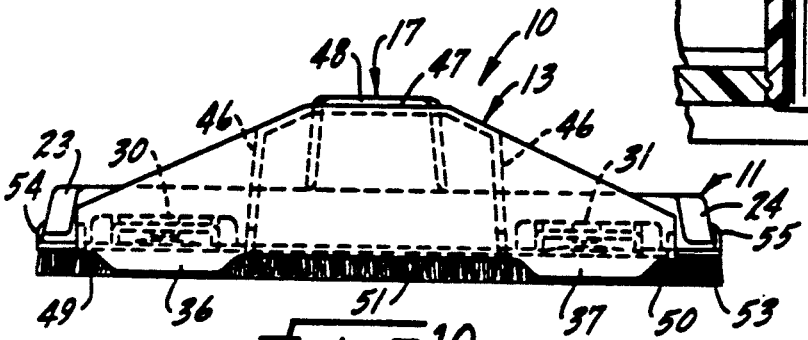
FIG. 10 is a front view of the paint trimming device of FIG. 1.

The device includes a base, indicated generally at 11 in FIGS. 1 and 9, a paint pad indicated generally at 12, and an edger attachment, here a face plate, indicated generally at 13 in FIGS. 1 and 10. Another edger attachment, consisting of a set of edger wheels 14 and 15 are shown in FIGS. 7 and 8.

Figure 11:
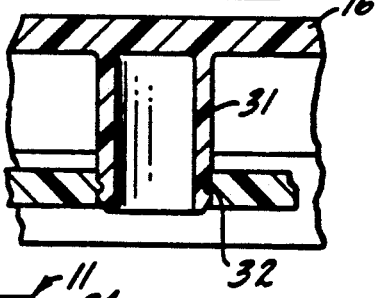
FIG. 11 is a detail view to an enlarged scale showing the releasable locking structure for accommodating the face plate mode of the trimming device as well as the wheeled mode.

The base 11 includes a top surface 16 from which a centrally located finger grip indicated generally at 17 projects upwardly to a convenient tinger gripping height. A pair of depressions or finger wells are indicated at 18, 19. A pair of rear abutment tabs, 20, 21, which flank a central abutment tab 26, shown best in FIGS. 2, 3, 7 and 8, are preferably integrally formed with base 11, and project downwardly beneath the plane formed by the lower peripheral surface 22 of the base 11. The tabs function to lock the paint pad in place after the pad is assembled to the base. A pair of wings 23, 24, function as front abutment members to keep a paint pad which has been assembled to the base from slipping forwardly. The front face 25 of the base is inclined forwardly and downwardly as best seen in FIGS. 8 and 9. A pair of cutouts are indicated at 28, 29 to provide clearance for wheels when wheels are used. A pair of wheel posts, indicated at 30, 31, are formed integrally with the base 11 and project downwardly from the underside of the top of surface 16 as best seen in FIG. 11. The posts are circular in contour and have a necked down portion 32 which forms part of a releasable locking system for holding, alternatively, wheels or the face plate 13.

Figure 2:
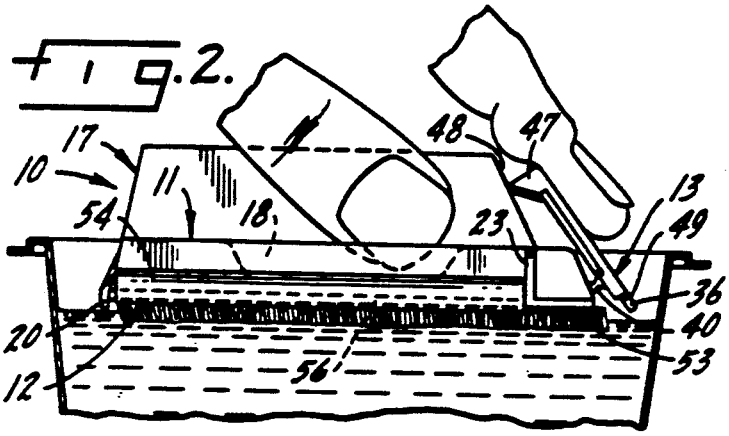
FIG. 2 is a side view of the paint trimming device shown in the position of being loaded with paint or other coating material.
Figure 4:
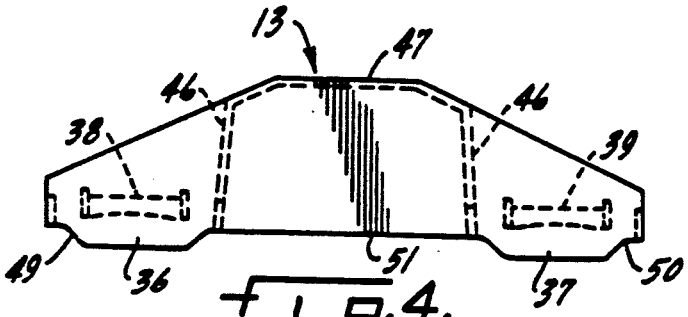
FIG. 4 is a front elevation of the face plate of the trimming device.
Figure 5:
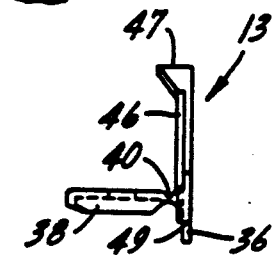
FIG. 5 is a left side view of the face plate of the trimming device.
Figure 6:
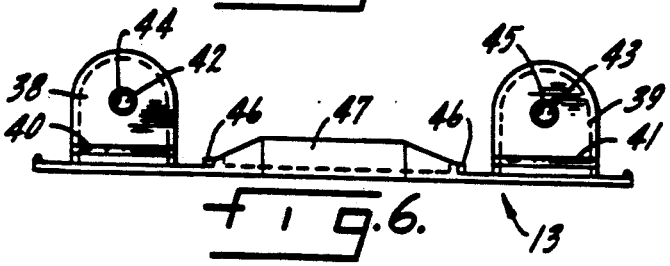
FIG. 6 is a top view of the face plate of the trimming device.

The face plate 13 is roughly trapezoidal in contour as best seen in FIG. 4. The lower or blade section of the face plate includes two runners 36, 37, which are integral with and project downwardly from the lower edge of the face plate. A pair of face plate holding tabs are indicated at 38, 39, projecting rearwardly from the face plate 13. Each holding tab is joined to the rear surface of the face plate 13 by material of reduced thickness, indicated at 40, 41, these portions forming a hinge whereby the orientation of the face plate with respect to the tabs 38, 39, may be changed as shown in FIG. 2. Apertures 42, 43 are formed in the tabs 38, 39 respectively, so as to enable the tabs, and thereby the face plate, to be received on the wheel posts 30, 31, after the wheels are removed. Internal flanges 44, 45, are formed in holes 42, 43 respectively, the flanges being of a size and location to snap into the necked down rings 32 in each of the posts 30, 31. In this instance, a reinforcing rib 46 extends from the bottom edge of the blade section to the top edge in a generally inverted U-shaped position. An inwardly projecting lip 47 extends rearwardly a short distance beyond the upper portion of the reinforcing rib 46 to form a spacer between the body of the face plate 13 and the front surface 48 of the finger grip 17 when the edger is being loaded with paint or other coating material. The face plate is re-oriented from a coating loading position to a coating application position by swinging along the hinge line formed by the aligned necked-down areas 40, 41. It will be noted that the runners 36, 37 do not extend completely out to the sides of the face plate 13, whereby notch-like open areas are formed at 49, 50. A longer central open area is indicated at 51.

Figure 3:
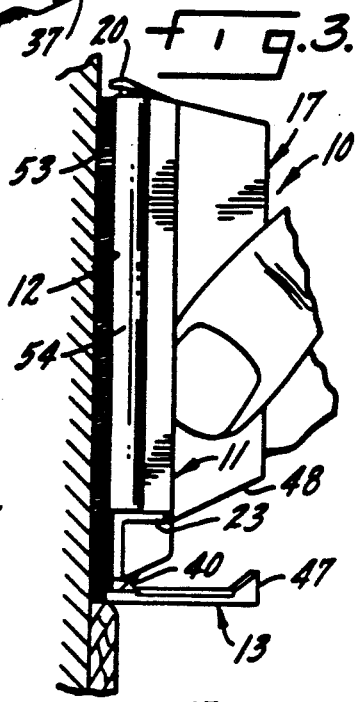
FIG. 3 is a side view of the paint trimming device shown as it is operated to trim a surface near an edge which has only a slight thickness of no more than on the order of about ⅛″–3/32″ thickness.

The paint pad 12 here consists of a flexible plastic backing 52 from which a plurality of bristles 53 project essentially downwardly a uniform distance to form a paint pad, the bristles being adhered to the plastic backing 52 by any suitable means. As best seen in FIGS. 2, 3 and 8, the bristles are canted slightly forwardly for a purpose which will appear hereinafter. The edges 54, 55, of the plastic backing are curled upwardly and inwardly to form a slideway to receive the side edge flanges 56, 57 of the base 11. The rear ends of the side edge flanges 56, 57 are tapered as at 58, 59, so that the paint pad 12 can be quickly and easily assembled to the base.

In operation the trimming device is held by its finger grip 17 in one hand of a user in such a way that the index finger of the user is free to pull the top of face plate 13 towards the front face 48 of finger grip 17 as best seen in FIG. 2. The aligned hinges 40, 41 enable the face plate 13 to pivot about the hinges 40, 41 so as to swing the face plate upwardly and away from the pad bristles 53 so that the bristles can be loaded with paint without getting paint on the face plate 13 and its associated runners 36, 37.

When the finger pressure on the top of face plate 13 is released, the face plate swings back into the trimming position of FIG. 3.

One important feature of the invention is that face plate 13 cooperates with the paint pad so that the trimming device can actually paint into an exact corner, a result which differentiates this invention over all of the prior art mentioned above. Specifically, the runners 36, 37 in conjunction with end notches 49, 50 and central open area 51 permit the forwardly canted bristles to place paint in an exact corner. That is, the thin, unpainted area which results from the use of the paint applying device of U.S. Pat. No. 3,172,140 is eliminated, and paint is applied precisely to the corner junction between the adjacent surfaces. The long central open area 51 also permits the bristles to deposit paint in a uniform coating right up to the junction formed with the adjacent surface as can be seen from FIG. 3; in essence, there is no blocking of paint application in an area the thickness of the face plate as occurs in use of the paint applying device of U.S. Pat. No. 3,172,140. It will be understood that the relation of the height of the runners to the lower ends of the bristles are important in ensuring the desired result, said runners being so arranged that they extend generally down to, but slightly short of, the lower ends of the bristles as shown best in FIG. 10. Specifically, if the runners extend too far, insufficient paint will be applied. If the runners do not extend far enough, the edge control of the invention will not be achieved because the peripheral bristles may spread outwardly beyond the exterior face of the runners. Runner clearances of up to about 1/64th inch above the ends of the bristles appear suitable.

By the same token, if the runners are too long in a longitudinal direction, not enough paint will be applied. If the runners are too small, the hand applied pressure may cause the runners to dig in and form a depression. Also, when the runners are too small, hand applied pressure will cause premature wear of the runners.

From a functional standpoint, when the trimming device with the face plate 13 is pressed against the area to be painted, portions of the flexible pad face are deformed and spread out around the runner portions of the device. The runners 36, 37 permit the peripheral portions of the spreading pad face to extend into the open areas 49, 50 next to the runners 36, 37 so that paint can be applied in the thickness area of the runners 36, 37 as the trimming device is slid back and forth along the corner formed by the adjacent surface as seen best in FIG. 3. It is critical that the height of the blade be controlled in relation to the height of the flexible pad face so that excessive pressure on the pad cannot cause the peripheral pad bristles to extend beyond the thickness of the runners and apply paint in an area beyond the runners; at the same time, however, the runners allow sufficient deforming or spreading of the peripheral bristles into the open areas represented by notches 49, 50 and central open area 51 so as to cover the thickness area of the runners.

It will also be understood that the necked down portions 32 of the wheel posts 30, 31 enable the face plate 13 or wheels 14, 15 to be used interchangeably with the paint pad, the necked down areas, when acting in conjunction with mating internal flanges 44, 45 of face plate 13 or similar internal flanges on wheels 14, 15 forming means for interchangeably securing wheel means or edge abutment means to the base 11 of the trimming device, as indicated by specific painting conditions such as ceiling edge or thin baseboard edge. This feature provides great flexibility to the user, and enables the retail vendor to offer a kit with both wheels and face plate so that one paint applicator device is suitable for all trimming conditions.

Although a preferred embodiment of the invention has been illustrated and described, it will at once be apparent to those skilled in the art that modifications may be made within the spirit and scope of the invention. Accordingly, it is intended that the scope of the invention be limited solely by the scope of the hereinafter appended claims when interpreted in light of the relevant prior art.

We claim:

1. In an improved trimming device for precisely painting surfaces up to but not beyond a junction, a paint pad, a base having hand gripping means and means for securing the paint pad to the base, and an edger carried by the base, said edger having a face plate extending at least a substantial distance along the front edge of the base, said edger having a runner means associated with one end portion of the face plate and, spaced therefrom, a second runner means associated with the other end portion of the face plate, said runner means projecting downwardly from the lower edge of the face plate.

said runner means, when oriented generally perpendicularly to the paint pad, terminating short of the edges of the paint pad and projecting downwardly only a distance sufficient to enable paint carried by the paint pad to be placed precisely up to a junction but not beyond.

2. The trimming device of claim 1 further characterized in that the runner means consists of a pair of runners having straight lower edges which are in alignment with one another, said runners being spaced from one another by an open center whereby a cut out region is formed between the runners and an essentially two location support is provided for contact between the trimming device and the surface to be painted.

3. The trimming device of claim 2 further characterized in that said edger further includes hinge means for orienting the edger in a position generally perpendicular to the paint pad and, also, at a position at an angle with respect to the paint pad whereby the lower portion of the runner means is elevated with respect to the lower portion of the paint pad when the edger is swung around the hinge means in a direction generally away from the paint pad.

4. The trimming device of claim 3 further characterized in that the hinge means enables the face plate of the edger to swing upwardly above and outwardly beyond the lower, leading edge of the paint pad under finger applied pressure to a position at which the runners are elevated a substantial distance vertically above the lower ends of the paint pad bristles whereby the paint pad can be loaded with coating without also contacting the runners with the source of coating.

5. The improved trimming device of claim 2 characterized in that the runners extend a distance of on the order of up to about 1/64th of an inch short of the ends of the bristles of the paint pad when the face plate is oriented in a normal, paint applying perpendicular position with respect to the paint pad.

6. The trimming device of claim 5 further characterized in that said edger further includes hinge means for orienting the edger in a position generally perpendicular to the paint pad and, also, at a position at an angle with respect to the paint pad whereby the lower portion of the edger is elevated with respect to the lower portion of the paint pad when the edger is swung around the hinge means in a direction generally away from the paint pad.

7. The trimming device of claim 6 further characterized in that the hinge means enables the face plate of the edger to swing upwardly above and outwardly beyond the lower, leading edge of the paint pad under finger applied pressure to a position at which the runners are elevated a substantial distance vertically above the lower ends of the paint pad bristles whereby the paint pad can be loaded with coating without also contacting the runners with the source of coating.

8. The trimmer device of claim 2 further including wheel means and means for interchangeably securing said edger and said wheel means to the base.

* * * * *